United States Patent [19]

Westgate

[11] Patent Number: 4,713,844

[45] Date of Patent: Dec. 22, 1987

[54] PROTECTIVE HELMET WITH FACE MASK SEALING MEANS

[75] Inventor: Charles A. Westgate, Carbondale, Pa.

[73] Assignee: Gentex Corporation, Carbondale, Pa.

[21] Appl. No.: 886,261

[22] Filed: Jul. 16, 1986

[51] Int. Cl.[4] ..... A42B 3/02

[52] U.S. Cl. ..... 2/411; 2/424

[58] Field of Search ..... 2/424, 6, 411, 417, 2/418, 419

[56] References Cited

U.S. PATENT DOCUMENTS 4,083,065 4/1978 Wanncke ..... 2/424

FOREIGN PATENT DOCUMENTS 1158494 7/1969 United Kingdom ..... 2/6

*Primary Examiner*—Doris L. Troutman

*Attorney, Agent, or Firm*—Shenier & O'Connor

[57] ABSTRACT

An arrangement in which a toggle mechanism on the outside of a proective helmet acts on an end of a nape strap outside the helmet to shorten the effective length of the nape strap within the helmet to move the wearer's head forward to bring the wearer's face into engagement with the face seal of a face mask attached to the helmet.

12 Claims, 4 Drawing Figures

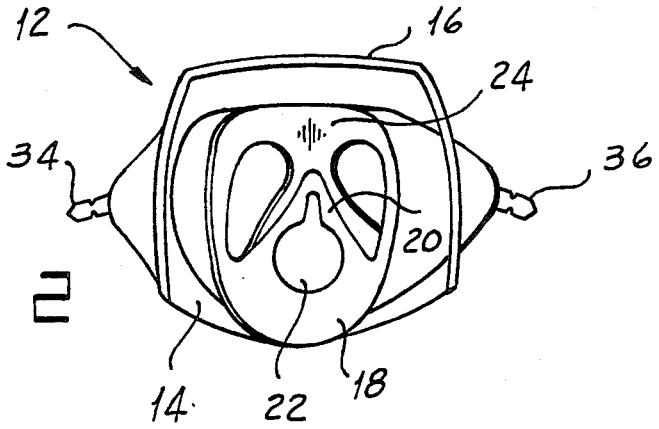
Fig 2
Fig 4
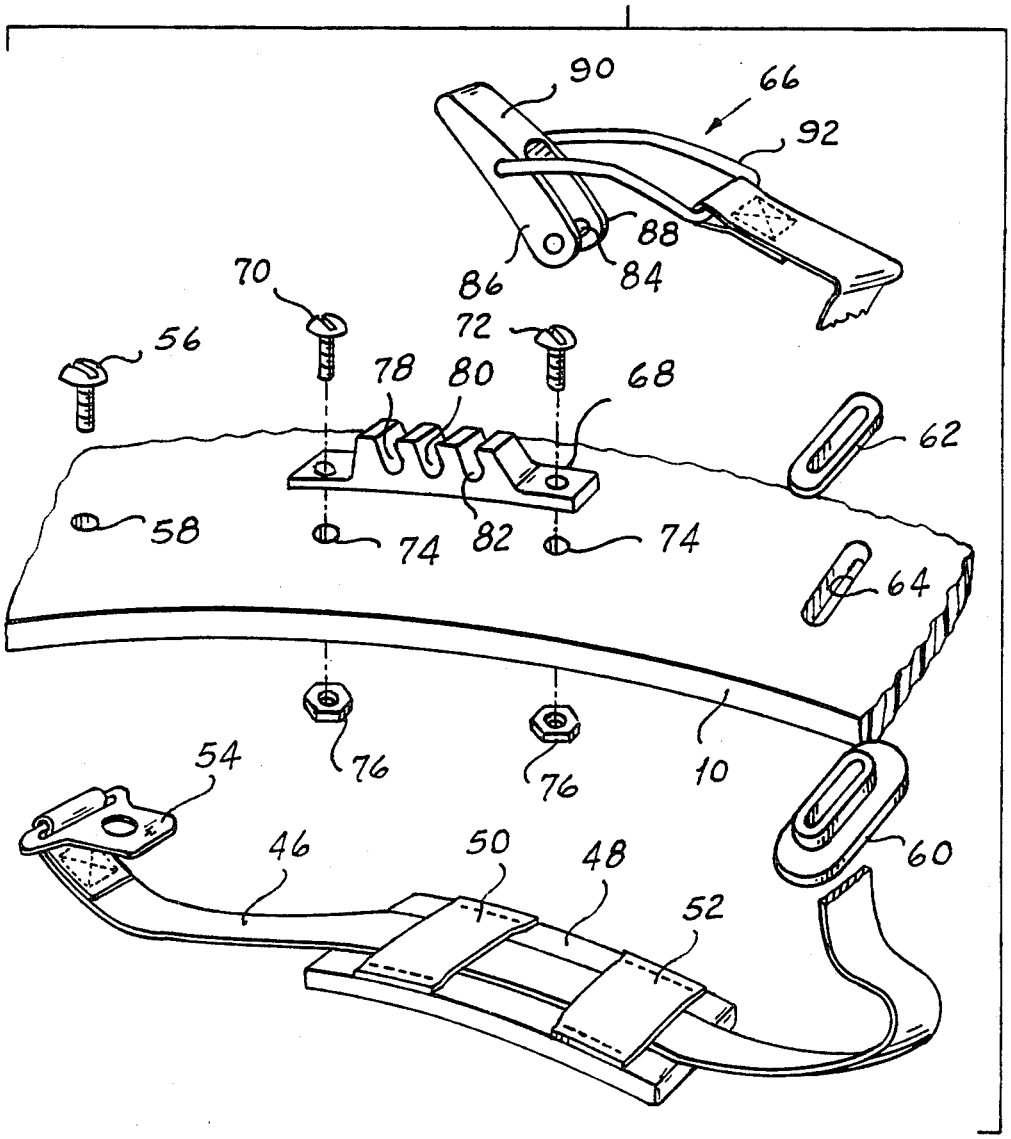

PROTECTIVE HELMET WITH FACE MASK SEALING MEANS

FIELD OF THE INVENTION

The invention is in the field of protective helmets and, more specifically, in the field of protective helmets provided with face masks having means adapted to form a seal with the face of a wearer.

BACKGROUND OF THE INVENTION

There are known in the prior art protective helmets which are provided with face masks having means adapted to provide an air tight seal with the wearer's face. Such helmets find use in any application in which the wearer's eyes, nose and mouth must be protected against the effect of noxious or poisonous vapors or gases.

It will readily be appreciated that an effective seal is essential if the wearer of the mask is to be afforded a good measure of protection. Various expedients have been employed in the art to cause the face seal firmly to engage the face of the wearer. For example, where the face seal is mounted on the helmet in a fixed position some adjustment may be made prior to donning the mask by adjusting the nape strap within the helmet as by a reel takeup mechanism or the like. Alternatively, the mask may be adjustably mounted on the helmet by, for example, multi-position mounting bayonet fasteners, adjustment straps, or fitting pads or a combination of these devices. While the methods of the prior art may result in the formation of an effective seal they do not provide the quick, expeditious and reliable operation which is essential in many instances, such for example as in a chemical or biological warfare situation.

SUMMARY OF THE INVENTION

One object of my invention is to provide a protective helmet and mask assembly with means for effectively forming a seal with the wearer's face.

Another object of my invention is to provide a protective helmet and mask assembly in which the seal between the face and the mask face seal may be made or broken by means on the helmet which is independent of the means mounting the mask on the helmet.

A further object of my invention is to provide a protective helmet and mask assembly with means for rapidly and expeditiously establishing and disestablishing a seal between the wearer's face and the mask seal.

Yet another object of my invention is to provide a readily operable face seal establishing means which is adjustable.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views:

FIG. 2 is a plan view from the inside of the mask shown in FIG. 1.

FIG. 4 is an exploded view illustrating the details of my arrangement for establishing a seal between a wearer's face and the mask face seal.

DESCRIPTION OF THE PREFERRED EMBODIMENT

Figure 1:
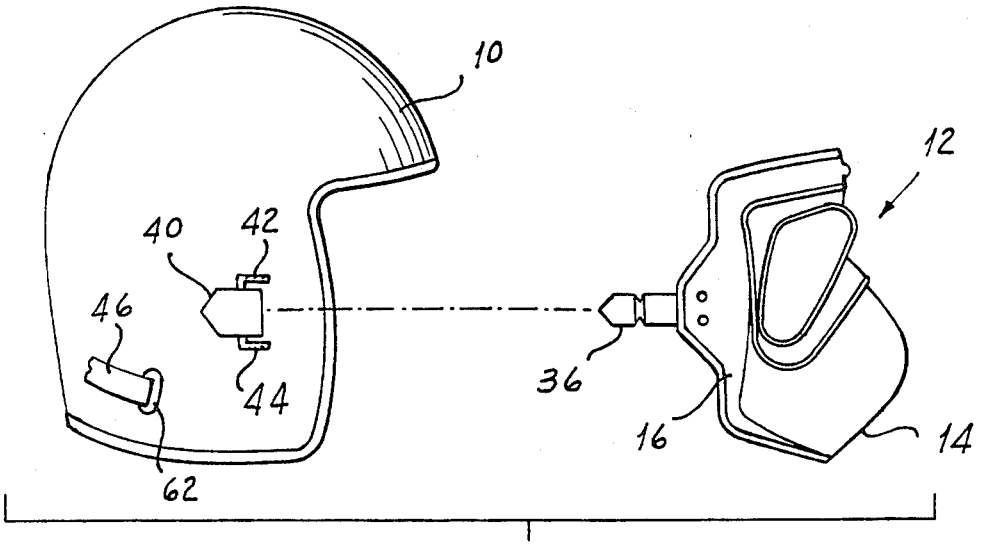
FIG. 1 is a side elevation of a protective helmet and mask before the mask is mounted on the helmet.
Figure 3:
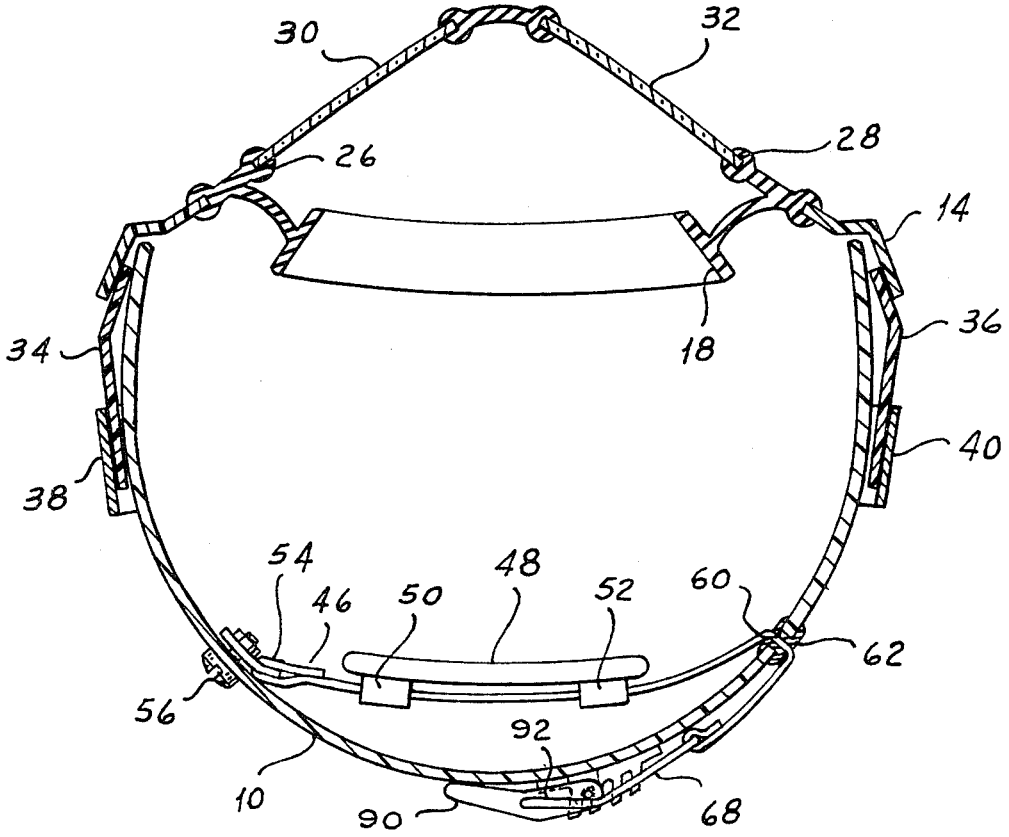
FIG. 3 is a sectional view of a helmet and mask assembly provided with my quick acting face seal establishing mechanism.

Referring now to the drawings, a protective helmet 10 of any type known to the art which is provided with my means for effecting a face seal with the sealing means of a face mask is adapted to be brought into assembled relationship with a face mask indicated generally by the reference character 12. The mask 12 includes a frame 14 which is vacuum formed from a suitable material such, for example, as a polycarbonate resin. The frame 14 is provided with an offset 16 which is adapted to be brought into registry with the helmet 10 around the periphery of the front of the opening therein.

The frame 14 carries a face seal 18 adapted to be brought into engagement with the wearer's face around the periphery thereof. A partition 20 forming part of the seal 18 divides the portion of the mask inside the seal into an oral-nasal cavity 22 and an ocular cavity 24. A pair of openings 26 and 28 formed in an integral part of the seal structure above the cavity 22 receive respective lenses 30 and 32.

The face mask 12 may be assembled on the helmet 10 by the use of bayonet fasteners of the type known to the art. For example, left and right-hand bayonets 34 and 36 carried by the face mask 12 may be inserted into respective housings 38 and 40 on the helmet 10. Each of the housings 40 carries a pair of manually releasable locking elements which, as is known in the art, snap into engagement with notches in the bayonet, such as the bayonet 36, inserted into the housing. Further, as is known in the art, the elements 42 and 44 may be squeezed between the thumb and forefinger to release the bayonet.

The helmet 10 includes a nape strap 46 on which a nape pad 48 is adjustably mounted by a pair of webbing strips 50 and 52 secured to the back of the pad 48 to form passages through which the strap 46 passes. I secure one end of the strap 46 to a fitting 54 of a type known in the art. A screw 56 passing through an opening 58 in the helmet 10 is adapted to secure the fitting 54 to the inside surface of the helmet.

A pair of elements 60 and 62 are brought into operative relationship with each other through a slot 64 in the helmet 10 to form a guide through which a strap 46 passes. My means for effecting a seal between the wearer's face and the face seal 18 includes a toggle mechanism indicated generally by the reference character 66. I secure the base 68 of the mechanism 66 to the helmet 10 by any suitable means, such for example as by screws 70 and 72 passing through spaced openings 74 in the helmet to receive nuts 76. I form the base 68 with a plurality of spaced pivot pin receiving slots 78, 80 and 82. A pivot pin 84 extends between the legs 86 and 88 of the operating lever of the toggle mechanism 66. Each of the slots 78, 80 and 82 is adapted to receive the pivot pin 84. The walls of each of the slots 78, 80 and 82 converge slightly from the base of the slot to the mouth thereof so that pivot pin 84 can be releasably snapped into the slots. The lever 90 pivotally receives the legs of a bail or buckle to which I secure the end of strap 46 remote from fitting 54 by doubling the strap over the bail and stitching it to itself.

In use of my assembly the wearer first dons the helmet 10 with the toggle latch in the release position in which the wearer may move his head rearwardly in the helmet. Next, the face mask is donned by inserting the bayonets 34 and 36 in the housings 38 and 40. Next the toggle mechanism is moved to the closed position to cause the nape strap 46 and pad 48 to move the wearer's head forward in the helmet to bring his face into firm sealing engagement with the face seal 18.

If the wearer discovers that upon first moving the toggle mechanism to closed position some adjustment is necessary, he releases the mechanism and repositions the pivot pin 84 in the slots 78, 80 and 82 to effect the desired adjustment.

It will be seen that I have accomplished the objects of my invention. I have provided a protective helmet and mask assembly with means for effectively forming a seal with the wearer's face. In my assembly the seal between the face and the mask face seal may be made or broken by means on the helmet which is independent of the means mounting the mask on the helmet. I have provided a protective helmet and mask assembly with means for rapidly and expeditiously establishing and disestablishing a seal between the wearer's face and the mask seal. My readily operable face seal establishing means is adjustable.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A helmet and face mask assembly including in combination, a helmet adapted to fit over the wearer's head, a face mask having a seal adapted to engage the wearer's face, interengageable means on said helmet and said face mask for securing said mask in position on said helmet in front of the wearer's face, means within said helmet adapted to be actuated to move the wearer's head forward relative to said helmet without changing the position of said mask on said helmet, and externally accessible means on said helmet operable to actuate said head-moving means to bring the wearer's face into engagement with said seal after said face mask has been attached to said helmet.

2. An assembly as in claim 1 in which said actuatable means comprises an element disposed within said helmet adapted to be actuated to move the wearer's head forward to bring the wearer's face into engagement with said seal after said face mask has been secured to said helmet and means mounted on the outside of said helmet for actuating said element.

3. An assembly as in claim 2 in which said element actuating means is a toggle mechanism.

4. An assembly as in claim 3 in which said toggle mechanism is adjustable.

5. An assembly as in claim 1 in which said actuatable means comprises a nape strap disposed within said helmet and means disposed outside said helmet for varying the effective length of said nape strap.

6. A helmet and face mask assembly including in combination, a helmet, a face mask having a seal adapted to engage the wearer's face, interchangeable means on said helmet and on said face mask for attaching said face mask to said helmet, and externally accessible actuatable means on said helmet for moving the wearer's head forward to bring the wearer's face into engagement with said seal after said face mask has been attached to said helmet, said actuatable means comprising a nape strap disposed within said helmet, means for securing one end of said nape strap to the interior of said helmet, an opening in said helmet for permitting passage of the other end of said nape strap to the outside of said helmet whereby said nape strap has an effective length between said opening and said securing means, and means connected to said other end of said nape strap for varying said effective length.

7. An assembly as in claim 6 including means mounting said length varying means on the outside of said helmet.

8. An assembly as in claim 7 in which said length varying means is a toggle mechanism.

9. An assembly as in claim 8 in which said toggle mechanism is adjustable.

10. A helmet and face mask assembly including in combination, a helmet, a face mask having a seal adapted to engage the wearer's face, interengageable means on said helmet and on said face mask for attaching said face mask to said helmet, a nape strap disposed within said helmet, means securing one end of said nape strap to the interior of said helmet, an opening in said helmet for permitting passage of the other end of said nape strap to the exterior of said helmet whereby said nape strap has an effective length extending between said opening and said securing means, a toggle mechanism comprising a base, means mounting said base on the outside of said helmet, an operating lever, means pivotally connecting one end of said lever to said base for movement of the other end of the lever between an operated position remote from said opening and a released position adjacent to said opening, a bail pivotally connected to said lever between the ends thereof, and means for securing the other end of the nape strap to said bail whereby the effective length of said nape strap is shortened as said operating lever moves from said released position to said operated position to move the wearer's head forward to bring the wearer's face into engagement with said seal after said face mask has been attached to said helmet.

11. An assembly as in claim 10 in which said operating lever is adjustably mounted on said base.

12. An assembly as in claim 10 in which said means mounting said operating lever on said base comprises a pivot pin on said lever, and a plurality of notches in said base for selectively receiving said pivot pin.

* * * * *

UNITED STATES PATENT AND TRADEMARK OFFICE

CERTIFICATE OF CORRECTION

PATENT NO. : 4,713,844

DATED : December 22, 1987

INVENTOR(S) : Charles A. Westgate

It is certified that error appears in the above-identified patent and that said Letters Patent are hereby corrected as shown below:

In the Claims:

Col. 4, claim 6, line 9, change "interchangeable" to --interengageable--.

Signed and Sealed this

Third Day of May, 1988

*Attest:*

*Attesting Officer*

DONALD J. QUIGG

*Commissioner of Patents and Trademarks*